United States Patent [19]

Tietjens

[11] Patent Number: 4,894,912

[45] Date of Patent: Jan. 23, 1990

[54] SHAVING APPARATUS

[75] Inventor: Eduard W. Tietjens, Eindhoven, Netherlands

[73] Assignee: U.S. Philips Corp., New York, N.Y.

[21] Appl. No.: 147,849

[22] Filed: Jan. 25, 1988

[30] Foreign Application Priority Data

Jan. 27, 1987 [NL] Netherlands ..... 8700186

[51] Int. Cl.[4] ..... B26B 19/14; B26B 19/10; B26B 19/06

[52] U.S. Cl. ..... 30/43.6; 30/43.5; 30/43.3

[58] Field of Search ..... 30/43.1, 43.2, 43.3, 30/43.6, 346.51, 43.5

[56] References Cited

U.S. PATENT DOCUMENTS

| | | | |
|---|---|---|---|
| 2,890,522 | 6/1959 | Bulova et al. | 30/43.6 X |
| 3,079,684 | 3/1963 | Hertzberg | 30/43.6 X |
| 4,707,915 | 11/1987 | Bakker et al. | 30/43.6 |

FOREIGN PATENT DOCUMENTS

| | | | |
|---|---|---|---|
| 37158 | 3/1977 | Japan | 30/43.6 |
| 136973 | 10/1979 | Japan | 30/43.6 |

*Primary Examiner*—Douglas D. Watts
*Assistant Examiner*—Paul M. Heyrana, Sr.
*Attorney, Agent, or Firm*—Ernestine C. Bartlett

[57] ABSTRACT

A shaving apparatus having a housing with a holder for a flexible cutting plate and a cutting member which has rigid cutting elements and can be driven so as to be rotatable with respect to the cutting plate, the cutting elements comprising cutting sides at the radial ends. The cutting plate comprises individual supporting disks.

8 Claims, 2 Drawing Sheets

SHAVING APPARATUS

FIELD OF THE INVENTION

The invention relates to a shaving apparatus having a housing with a holder for a flexible cutting plate and a cutting member which can be driven rotatably with respect to the cutting plate and has rigid cutting elements, said cutting elements comprising cutting sides at the radial ends.

BACKGROUND OF THE INVENTION

In order to obtain a good shaving result it is of importance for the cutting plate to readily adjoin the cutting member. In a known construction as is described in French Patent Specification 994 890 this is obtained by pulling the cutting plate against the cutting member by means of a resilient element. However, the larger the forces between the cutting member and the cutting plate the larger will be the frictional losses and the detrition.

It is known from French Patent Specification 1 050 751 to stretch the flexible cutting plate over wall parts of the holder. In practice, however, it is difficult to manufacture the holder which is usually of a synthetic resin with a sufficient accuracy to avoid differences in shape between the cutting plate and the cutting member which will adversely influence the shaving result.

SUMMARY OF THE INVENTION

It is the object of the invention to avoid the said disadvantages by providing a shaving apparatus having a housing with a holder for a flexible cutting plate and a cutting member which can be driven rotatably with respect to the cutting plate and has rigid cutting elements, said cutting elements comprising cutting sides at the radial ends, wherein the apparatus is characterized in that the cutting plate comprises individual supporting disks.

Special embodiments are also present in which (a) the individual supporting disks are connected to the holder and the cutting member is journalled in the supporting disks; (b) the cutting member can be moved with respect to the supporting disks against the action of a resilient element; (c) the supporting disks are supported by a shaft of the cutting membered journalled in the holder; and (d) the supporting disks are supported resiliently with respect to the shaft.

BRIEF DESCRIPTION OF THE DRAWINGS

The invention will now be described in greater detail with reference to a description of an embodiment shown in the Figures in which.

DETAILED DESCRIPTION OF THE PREFERRED EMBODIMENTS

Figure 1:
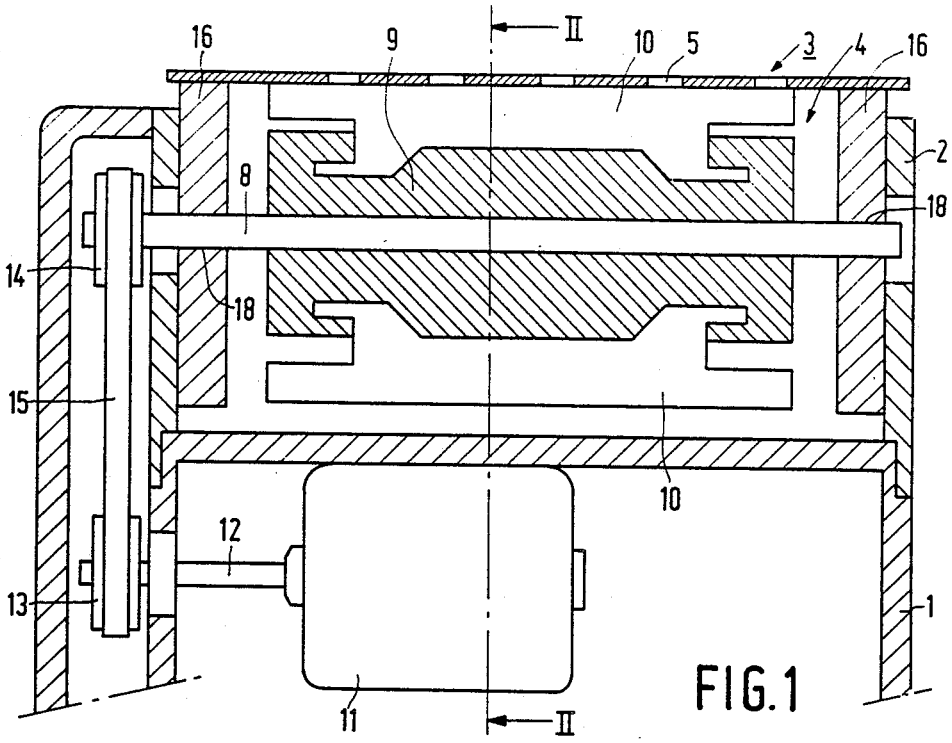
FIG. 1 is a diagrammatic longitudinal sectional view of a shaving apparatus according to the invention.
Figure 2:
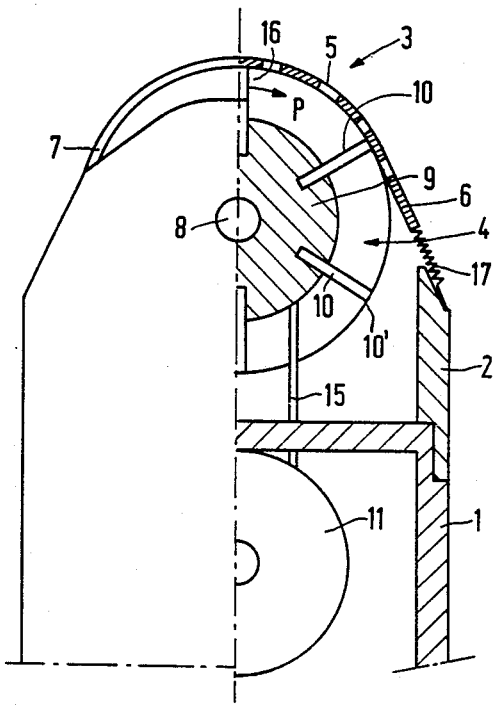
FIG. 2 is partly a sectional view taken on the line II—II of FIG. 1 and partly an elevation.

The shaving apparatus shown in FIGS. 1 and 2 comprises a housing 1 having a holder 2 for a flexible cutting plate 3 and a cutting member 4 which can be driven so as to be rotatable with respect to the cutting plate.

The cutting plate 3 comprises hair entrance apertures 5 and also comprises a first and a second edge portion 6 and 7, respectively, with which the cutting plate is connected to the holder 2.

The cutting member 4 comprises the shaft 8, the hub 9 and the cutting elements 10. The shaft 8 and the cutting elements 10 are placed, for example, in the matrix for the hub to be manufactured from a synthetic resin and by means of an injection moulding process so that after curing of the synthetic resin the shaft 8, the hub 9 and the cutting elements 10 form one rigid assembly.

The shaft 8 is journalled in the holder 2 so as to be rotatable and is driven by the electric motor 11. On the shaft 12 of the electric motor and on the shaft 8 the pulleys 13 and 14, respectively, are provided which are coupled by means of the belt 15. In this manner the cutting member 4 can be driven so as to be rotatable with respect to the cutting plate 3, for example, in a direction indicated by the arrow P. When the shaving apparatus is moved over the skin to be shaved, a hair which projects inwardly through a hair entrance aperture 5 will be cut as a result of the cooperation of the cutting plate 3 and a cutting edge 10' of a cutting element 10.

The shaft 8 is journalled in two individual supporting disks 16 on each side of the cutting member 4. These individual supporting disks may already be placed on the shaft 8 in the final phase of the manufacture of the cutting member 4 and be ground simultaneously with the cutting member 4 so that cutting member 4 and supporting disks 16 have exactly the same diameters. During assembly of the cutting member 4 in the holder 2 the supporting disks 16 are then connected to the walls of the holder 2 by means of known connection methods, for example, with screw bolts or by means of a gluing, welding or riveting process. The cutting plate 3 is then stretched over the supporting disks 16 by means of a resilient element 17. The part of the cutting plate 3 formed by the supporting disks 16 is bent in this manner according to a cylinder surface which corresponds exactly with the imaginary cylinder surface on which the cutting edges 10' of the cutting elements are situated. The accuracy with which the cutting member 4 engages the cutting plate 3 is hence determined by the accuracy of the grinding process with which cutting member 4 and supporting disks 16 are ground simultaneously and by the accuracy with which the shaft 8 is journalled in the bores 18 of the supporting disks 16. The relevant manufacturing methods can also be performed in a series-production process in a comparatively simple manner and with a high degree of accuracy. The tensile force exerted on the cutting plate 3 by the resilient element 17 is compensated by the supporting disks 16 so that in principle no pressure forces need occur between the cutting plate 3 and the cutting member 4. The play between the cutting member 4 and the cutting plate 3 is in principle determined by the play of the shaft 8 in the bores 18. In this manner a light running cutting member 4 is obtained having no frictional losses and a low detrition while an effective shaving effect is nevertheless ensured.

Figure 3:
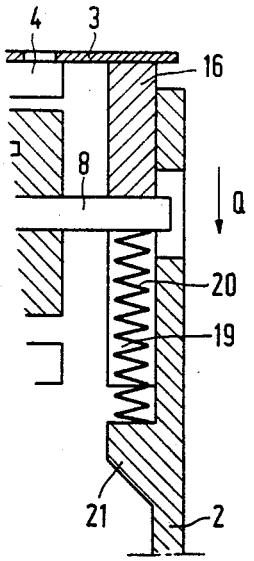
FIGS. 3, 4 and 5 show three special embodiments in a detail which corresponds to the right side of the sectional view in accordance with FIG. 1.
Figure 4:
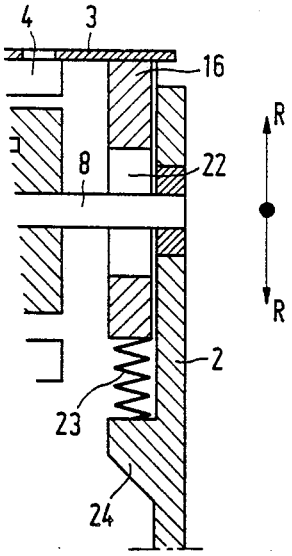
Figure 5:
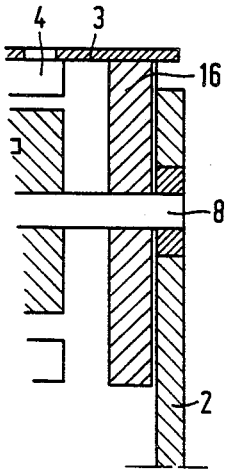

FIGS. 3, 4 and 5 show modified embodiments of the constructions shown in FIGS. 1 and 2 in a detail which corresponds to the right side of the cross-sectional view of FIG. 1. These modified embodiments relate to the construction of the supporting disks 16 and the bearing of the end of the shaft 8 and are constructed in a corresponding manner for each construction on the left-hand side of the cutting member 4.

In the FIG. 3 embodiment the supporting disk 16 which is again rigidly connected to the holder comprises a slot 19. The compression spring 20 which is compressed between the shaft 8 and a support 21 which forms part of the holder 2 is present in the slot 19. In this manner the cutting member 4 can be moved against the action of the resilient elements 20 with respect to the supporting disks 16 in the direction of the arrow Q. The advantages of the embodiment shown in FIGS. 1 and 2 are also maintained in this embodiment. However, when too high a force is exerted on the cutting member 4 via the cutting plate 3, the cutting member 4 can deviate against the action of the resilient elements 20 so that damage can be prevented.

In the FIG. 4 embodiment the shaft 8 of the cutting member is journalled in the holder 2. The supporting disk 16 is not connected to the holder 2 and comprises a slotted hole 22 so that the supporting disk can be moved in the directions R with respect to the shaft 8. The supporting disk 16 is supported by a resilient element 23 which is stretched between the supporting disk and a support 24 of the holder 2. The magnitude of the forces occurring between the cutting plate 3 and the cutting member 4 can now be adjusted accurately in a simple manner during the manufacture dependent on the resilient elements 17 and 23.

In the FIG. 5 embodiment the shaft 8 is also journalled in the holder 2. The supporting disk 16 is not connected to the holder 2 and is journalled so as to be rotatable on the shaft 8. Starting from exactly the same diameters of supporting disk 16 and cutting member 4 the cutting plate 3 will initially be supported substantially by the cutting member 4 as a result of a slight play in the bearing between the supporting disk 16 and the shaft 8. However, after the apparatus has been used and the diameter of the cutting member 4 has been reduced slightly by detrition, the cutting plate 3 is supported substantially by the supporting disks 16, the cutting plate 3 very readily adjoining the cutting member 4.

I claim:

1. A shaving apparatus having a housing with a holder for a flexible cutting plate and a cutting member which can be driven so as to be rotatable with respect to the cutting plate comprising a shaft and rigid cutting elements with radial ends, the cutting elements comprising cutting sides at the radial ends, and wherein the cutting plate is stretched over individual supporting disks provided on each side of the cutting member, the shaft being journalled in the holder and in the individual supporting disks.

2. A shaving apparatus as claimed in claim 1, wherein the individual supporting disks are connected to the holder on each side of the cutting member and the cutting member is journalled in the supporting disks.

3. A shaving apparatus as claimed in claim 2, wherein the cutting member can be moved with respect to the supporting disks against the action of a resilient element.

4. A shaving apparatus as claimed in claim 1, wherein the supporting disks are supported by a shaft of the cutting member journalled in the holder.

5. A shaving apparatus as claimed in claim 4, wherein the supporting disks are supported resiliently with respect to the shaft.

6. A shaving apparatus as claimed in claim 1, in which the supporting disks are journalled to be rotatable on the shaft, the cutting plate being supported substantially by the supporting disks.

7. A shaving apparatus having a housing with a holder for a flexible cutting plate and a cutting member which can be driven so as to be rotatable with respect to the cutting plate comprising a shaft and rigid cutting elements with radial ends and wherein the cutting plate is provided with individual supporting disks, the shaft being journalled in the holder and in the individual supporting disks, at least one supporting disk comprising a slot containing a compression spring compressed between the shaft and the holder.

8. A shaving apparatus having a housing with a holder for a flexible cutting plate and a cutting member which can be driven so as to be rotatable with respect to the cutting plate comprising a shaft and rigid cutting elements with radial ends and wherein the cutting plate is provided with individual supporting disks, the shaft being journalled in the holder and in the individual supporting disks, the individual supporting disks being supported by a resilient element stretched between the supporting disk and a support of the holder, each supporting disk comprising a slot whereby it is movable in a direction perpendicular to the shaft.

* * * * *